United States Patent [19]

Saito et al.

[11] 4,394,431

[45] Jul. 19, 1983

[54] METHOD FOR DEVELOPING AN ELECTROSTATIC LATENT IMAGE WITH A LIQUID DEVELOPER

[75] Inventors: Takashi Saito, Ichikawa; Junichi Sakurayama; Tsuyoshi Watanabe, both of Kawasaki, all of Japan

[73] Assignee: Canon Kabushiki Kaisha, Tokyo, Japan

[21] Appl. No.: 307,523

[22] Filed: Oct. 1, 1981

Related U.S. Application Data

[63] Continuation of Ser. No. 97,861, Nov. 27, 1979, abandoned.

[30] Foreign Application Priority Data

Dec. 12, 1978 [JP] Japan ..... 53-153966

[51] Int. Cl.[3] ..... G03G 15/10

[52] U.S. Cl. ..... 430/119; 118/264

[58] Field of Search ..... 427/428, 429; 430/117, 430/119; 118/264, 262

[56] References Cited

U.S. PATENT DOCUMENTS 3,776,133 12/1973 Ritzerfeld ..... 118/264

3,910,186 10/1975 D'Amato et al. ..... 118/264

FOREIGN PATENT DOCUMENTS 52-40336 3/1977 Japan .

*Primary Examiner*—John E. Kittle

*Assistant Examiner*—John L. Goodrow

*Attorney, Agent, or Firm*—Fitzpatrick, Cella, Harper & Scinto

[57] ABSTRACT

A method for developing an electrostatic latent image comprising bringing a rigid member into pressure contact with a rotary member having a porous elastic member in the form of a layer provided in the periphery thereof to allow said elastic member to contain therein liquid developer in accordance with elastic deformation of the elastic member, urging said rotary member against an electrostatic latent image bearing surface and rotating said rotary member to supply the liquid developer to said bearing surface, thereby carrying out development of the electrostatic latent image, which comprises regulating the amount of elastic deformation of said elastic member in the direction of the thickness upon pressure contact thereof with said rigid member so as to be equivalent to or larger than that of said elastic member in the direction of the thickness upon pressure contact thereof with said bearing surface to conduct said development.

6 Claims, 3 Drawing Figures

METHOD FOR DEVELOPING AN ELECTROSTATIC LATENT IMAGE WITH A LIQUID DEVELOPER

This is a continuation of application Ser. No. 097,861, filed Nov. 27, 1979 now abandoned.

BACKGROUND OF THE INVENTION

1. Field of the Invention

The present invention relates to a method for developing an electric latent image, or electrostatic latent image formed in the field of image forming process such as electrophotography and electrostatic recording method, by means of a liquid developer.

2. Description of the Prior Art

In the prior art of the image forming technique such as electrophotography and electrostatic recording method, there are already known various methods of developing a latent image formed on a carrier for electrostatic latent image such as a photosensitive member or electrostatic recording material by means of a developer in the form of liquid (hereinafter called liquid developer). Such liquid developing method comprises bringing a liquid developer, containing a dispersion of toner particles in an insulating carrier liquid having a volume resistivity of $10^{10}$ ohm·cm or above and a dielectric constant of 3 or below, for example paraffinic hydrocarbons, into contact with a surface holding an electrostatic latent image so that the toner particles in the carrier liquid are attracted by and adsorbed on the electrostatic latent image (hereinafter called electrostatic image), thereby rendering the electrostatic image visible. In such a kind of liquid developing method, the achievement of high-speed development has been an important object in recent years. In order to achieve the high-speed liquid development, it is necessary to supply a liquid developer of a high concentration to a surface holding an electrostatic image and to perform prompt recovery of excessive liquid developer with good efficiency. It is also important to obtain a developed image of satisfactory quality from which excessive liquid developer is sufficiently removed.

As a method substantially satisfying some of the above-mentioned requirements for such liquid development, there is known a method of employing an elastic member capable of holding liquid therein and provided with a liquid-permeable surface as a supply means for a liquid developer and conducting the development of an electrostatic image in a portion of the electrostatic image-holding surface where said elastic member is maintained in pressure contact therewith, by means of the liquid developer squeezed out of the elastic member. Such method is regarded superior to other liquid developing methods such as those employing a dipping tank for liquid developer and utilizing a jet of liquid developer in that the squeeze supply of liquid developer and suction removal of excessive liquid developer can be effected simultaneously in accordance with the pressure deformation of the elastic member. This elastic member can be formed into a rotary member in the shape of a roller or endless belt (hereinafter referred to collectively as elastic roller). As an example of such elastic roller there is disclosed, for example Japanese Patent Laid-Open No. 40336/1977, a roller of a structure in which a sponge layer is firmly fixed to a central shaft and its periphery is covered with a flexible net member. Such elastic roller is regarded considerably suitable and useful in the application for the development of an electrostatic image as it can be rotated while in pressure contact with a surface of a rigid member such as a photosensitive member or an insulating member to form a nip of a desired width and has functions of squeezing out liquid contained in the roller and absorbing the liquid thereinto. However, while the liquid developing method using an elastic roller is considered to have the above-mentioned advantages, some disadvantages as given below have been found from the developing result in such liquid developing method. That is, when the developing operation is repeated many times, the density of the developed image is gradually reduced and the image become blurred. Also in the copying operation for one sheet of paper, the image developed by a developing roller in the last copying cycle appears in another developed image, particularly in the black area of intermediate tone, obtained in the next copying cycle. In other words, the ghost image phenomenon takes place. Further, undeveloped area remains or lack of uniformity in image density is present in a portion of the visualized image.

SUMMARY OF THE INVENTION

It is therefore the principal object of the present invention to provide a method for developing an electrostatic image by using an elastic roller which is capable of eliminating the above-mentioned various drawbacks associated with the conventional liquid developing method.

It is another object of the present invention to provide a method for developing an electrostatic image which is capable of avoiding various disadvantages in the development such as reduction in the density of the developed image, formation of ghost image, incomplete development and the like and allowing the high-speed liquid development.

It is a further object of the present invention to provide a method for developing an electrostatic image which is able to give a developed image of a good quality at high speed and in a stable manner.

According to the present invention, there is provided a method for developing an electrostatic latent image comprising bringing a rigid member into pressure contact with a rotary member having a porous elastic member in the form of a layer provided in the periphery thereof to allow said elastic member to contain therein liquid developer in accordance with elastic deformation of the elastic member, urging said rotary member against an electrostatic latent image bearing surface and rotating said rotary member to supply the liquid developer to said bearing surface, thereby carrying out development of the electrostatic latent image, which comprises regulating the amount of elastic deformation of said elastic member in the direction of the thickness upon pressure contact thereof with said rigid member so as to be equivalent to or larger than that of said elastic member in the direction of the thickness upon pressure contact thereof with said bearing surface to conduct said development.

DESCRIPTION OF THE PREFERRED EMBODIMENTS

The elastic roller to be used as a developing roller in the present invention may be of various structures as conventionally known. However, for reference, a typical example of the elastic roller is shown in FIG. 1 as it relates to the description hereafter.

Figure 1:
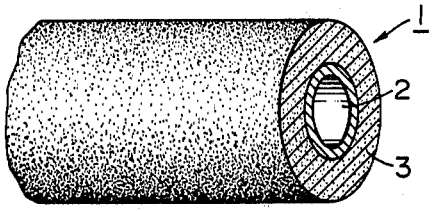
FIG. 1 is a schematic perspective view showing an example of a developing roller used in the present invention.

In the structure shown in FIG. 1, the elastic roller 1 comprises a central member 2 made of a rigid material such as a metal or a hard synthetic resin and a porous elastic member 3 having liquid-retentivity made of a porous elastic material such as sponge rubber or the like with the porous elastic member 3 being formed in a uniform thickness on the periphery of the central member 2. Although not shown, the porous elastic member 3 may be covered with a flexible net member. In this case, the developing function of the elastic roller is further improved.

When the elastic roller 1 is utilized as a developing roller as in the present invention, the porous elastic member 3 is preferably formed into a layer generally having a thickness of about 1.0 mm–10 mm for the purpose of maintaining the developing function of the roller 1 at the practical level.

The porous elastic member 3 is firmly fixed to the central member 2, for example by means of an adhesive. In case that the net member is provided, it is supported around the porous elastic member 3 by the recovering force of the porous elastic member 3 which is covered by the net member 4 in a somewhat compressed state. Therefore, the porous elastic member 3 can rotate integrally with the central member 2 when it is driven. Also in case of providing the net member 4, the three members 2, 3 and 4 can rotate integrally. The porous elastic member 3 is capable of absorbing and squeezing out liquid such as liquid developer in accordance with the deformation thereof since it has elastically deformable continous pores.

The porous elastic member 3 may be formed of any material which allows absorption and squeeze-out of liquid according to the deformation thereof and is provided with appropriate elasticity. The material may include for example foam materials and porous materials such as polystyrene, polyethylene, polyurethane, polyvinyl chloride, styrenebutylene rubber (SBR), butadiene-acrylonitrile rubber (NBR) and the like, and elastic materials formed of natural, synthetic or metal fibers. The porous elastic member 3 preferably has an Asker C hardness of 10–40 (measured in accordance with the standard set by the Rubber Society of Japan, SRIS-0101-1968).

The central member 2 functions to support the porous elastic member 3 and is generally composed of a rigid material, for example a metal such as aluminum or a plastic material such as polyoxymethylene, polyamide and the like. Further, the surface net member 4 may be a flexible net obtained by weaving or knitting thin wire of stainless steel, natural fiber, synthetic fiber or the like. It is preferably of 100–300 mesh, through the opening of which liquid can enter or come out from the porous elastic member 3.

Now, the prior art will be considered with respect to the case wherein the elastic roller as mentioned above is applied to the developing station in an actual image forming apparatus.

Figure 2:
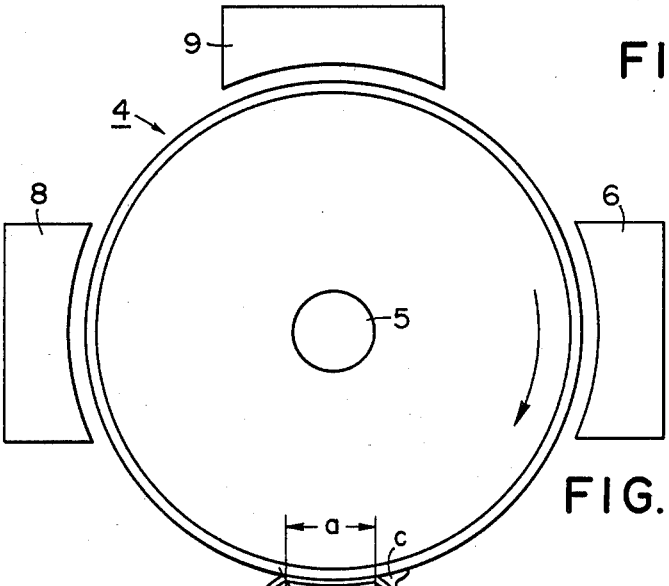
FIGS. 2 and 3 are schematic cross-sectional views showing the main portion of electrophotographic copying machine for explanation of the present invention.

Referring to FIG. 2 showing a schematic cross-sectional view of an electrophotographic copier, there are illustrated a photosensitive member 4 of a drum shape rotating in the direction of the arrow around a rotary shaft 5, a latent image-forming station 6 for forming an electrostatic latent image on the photosensitive member 4, a developing station 7, a transfer station 8 for transferring a developed image to a transfer material and a cleaning station 9 for cleaning unnecessary developer from the photosensitive member surface and erasing unnecessary latent image. The developing station 7 is positioned under the photosensitive member 4 and is essentially composed of a liquid tank 11 for containing liquid developer 10, a developing roller 12 consisting of the elastic roller of the structure exemplified in FIG. 1 and being immersed partially in the liquid developer 10 contained in the liquid tank 11, and a refreshing roller 13 maintained in pressure contact with the developing roller 12. When the copying operation starts with the copier, the photosensitive member 4 and the developing roller 12 are rotated, in a mutually pressed state, in opposite directions shown by the arrows at substantially the same speed. The developing roller 12 comes into contact with the photosensitive member 4 in a state sufficiently impregnated with the liquid developer 10 to form a nip portion ("a" portion in FIG. 2). An electrostatic image previously formed on the photosensitive member 4 is developed with liquid developer ("c" portion in FIG. 2) squeezed out from an elastic member 15 of the developing roller 12 and that ("a" portion) present between the photosensitive member 4 and developing roller 12, that is, the nip portion. Successively, when the developing roller 12 is rotated so that the compressed portion thereof leaves the periphery of the photosensitive member 4, the excessive liquid developer in the vicinity of the photosensitive member 4 is absorbed into the elastic member 15 by the recovering force thereof from the compressed state. Then, the developing roller 12 is further rotated to bring it into pressure contact with the refreshing roller 13 in the liquid developer 10 so that the liquid developer contained in the elastic member 15 is replaced and replenished for the next developing cycle.

The developing roller 12 used in the above example is composed of a central member 14 made of a rigid material such as a metal or hard synthetic resin, a porous elastic member 15 having liquid-holding ability made of sponge rubber of a uniform thickness and provided around the central member, and a net member 16 covering the periphery of the elastic member 15.

In the above-mentioned development, the developing roller 12 can squeeze out liquid developer contained therein when it comes into pressure contact with the photosensitive member 4, thereby developing an electrostatic image and also can absorb the excessive liquid developer present on the photosensitive member 4 into the pores of the roller when restored to the original state from the compressed state. Thus, the elastic member 15 in the "d" portion in FIG. 2 of the developing roller 12 where the development is completed includes the pores containing liquid developer of low toner concentration such as excessive liquid developer, those sucking therein air and hardly containing liquid developer, those impregnated with predetermined liquid developer and the like pores.

In the prior art, various development drawbacks are often found, which is probably due to the fact that the portion of the developing roller 12 where the content of the liquid developer contained therein is not uniform, that is, the "d" portion in FIG. 2 is not made sufficiently uniform in the content of the liquid developer by the function of the refreshing roller 13. For example, while the development is repeated many times, the toner concentration of the liquid developer contained in the developing roller is gradually reduced since exchange or replenishment of fresh liquid developer is not sufficiently effected, and as a result, the density of the developed image becomes disadvantageously decreased. Further, when the next development is carried out by the developing roller containing liquid developer, the toner concentration of which is not uniform depending on the pore, a ghost image is disadvantageously formed on the visualized image, or an undeveloped portion remains.

The inventors have found that sufficient and perfect refreshment, i.e. exchange and replenishment of liquid developer in the developing roller are required in order to resolve the above-mentioned drawbacks and they have established a concrete solution for that purpose. In the present invention, the refreshment effect of liquid developer is improved by regulating mutual relationship between deforming amount of the elastic member when the developing roller is brought into pressure contact with the photosensitive member and that of the elastic member when the developing roller is in pressure contact with the refreshing roller.

Figure 3:
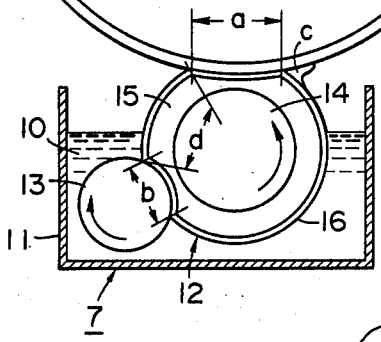
Figure 3:
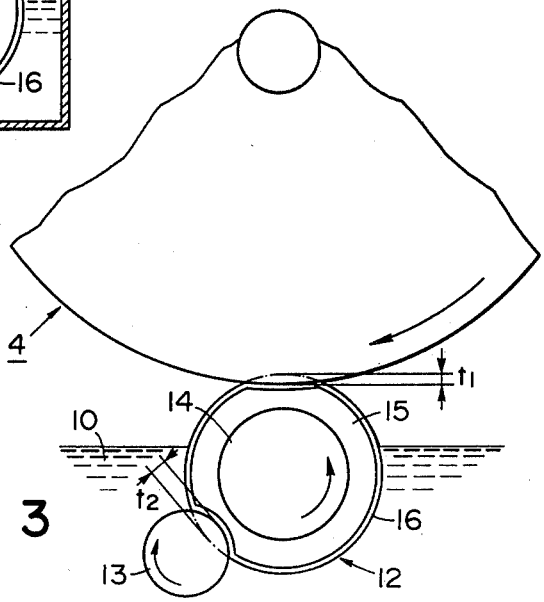

Referring to FIG. 3 in which the same components as in FIG. 2 are indicated by the same numerals as in FIG. 2, the present invention will be further explained in detail. When the developing roller 12 comes into pressure contact with a portion of the periphery of the photosensitive drum 4 under predetermined pressure, the porous elastic member 15 constituting the developing roller 12 is deformed by the pressing force. The deformation amount "$t_1$" of the elastic member 15 in the direction of the thickness is determined by the foregoing pressing force and the curvature of the photosensitive drum 4 and the developing roller 12. At the time of the deformation of the developing roller 12, as in the case with FIG. 2, an electrostatic image formed on the photosensitive member 4 is developed with liquid developer squeezed out from the roller 12, and the excessive liquid developer is sucked in the roller 12 when the elastic member 15 is restored from the compressed state. That portion of the elastic member 1 of the developing roller 12 which portion has been compressed to a thickness "$t_1$" during the developing step and is restored to the original form immediately after the developing step includes portions of various states, for example those containing liquid developer with decreased toner concentration, sucking therein air and containing the predetermined liquid developer. In the present invention, it is necessary to completely eliminate the lack of uniformity in the content of the liquid developer contained in the developing roller 12 by utilizing the function of the refreshing roller 13. It has been found that in order to achieve such uniformity in the developing roller 12, exchange of liquid developer should be carried out, at least, within the portion of the elastic member 15 corresponding to that compressed to thickness "$t_1$" from the surface thereof. Such exchange of liquid developer can be achieved by bringing the refreshing roller 13 into pressure contact with the developing roller 12 to deform the elastic member 15 of the roller 12 to the thickness equal to or larger than "$t_1$". In other words, arrangement of the three members, i.e. the photosensitive member 4, developing roller 12 and refreshing roller 13 or mutual pressing forces among them are regulated so that the relation: $t_1 \leqq t_2$ is satisfied wherein $t_1$ is the thickness of the elastic member 15 deformed when the elastic member 15 is in pressure contact with the photosensitive member 4, or the amount of deformation of the elastic member 15 in the direction of the thickness upon such pressure contact and $t_2$ is the thickness of the elastic member 15 deformed when such member is in pressure contact with the refreshing roller 13, or the amount of deformation of the elastic member 15 in the direction of the thickness upon such pressure contact. In view of the limit of the concrete pressing force as explained hereinafter, the value of "$t_2$" is preferably adjusted so as not to exceed $\frac{2}{3}$ of the thickness of the elastic member 15. In the present invention, the refreshing roller 13 is preferably made of a rigid material such as a metal or hard plastic material for the purpose of securely deforming the developing roller 12 and may be arranged not only at the position shown in the drawing, but also at any position as long as the refreshing roller 13 comes into contact with portion of the developing roller 12 immersed in the liquid developer.

As mentioned above, in the present invention, various drawbacks seen in the prior art are completely resolved by controlling the deformation amount of the elastic member 15 constituting the developing roller 12 in the direction of the thickness produced when the developing roller 12 comes into pressure contact with the refreshing roller 13 so as to be substantially equivalent to or larger than the deformation amount of the elastic member 15 in the direction of the thickness produced when the developing roller 12 comes into pressure contact with the photosensitive member 4. Further, in bringing the present invention into practice, the pressing force acting between the developing roller 12 and the photosensitive member 4 is required to be at least 100 g/cm in linear pressure, i.e. load applied per 1 cm in the longitudinal direction of the developing roller, for the purpose of allowing the developing roller 12 to carry out sufficient squeeze-out and absorption of liquid developer. But, when the pressing force is too strong, various disadvantages are often observed. For example, the porous elastic member 15 is strongly brought into pressure contact with the surface of the photosensitive member so that the developed image is disordered and the surface of the roller is creased or folded, thereby forming undesired crease pattern on developed image and further the roller is destroyed. Therefore, the pressing force should be restricted to at most about 800 g/cm in linear pressure. In view of the foregoing, the compressing force used in the present invention is practically in the range of about 100–800 g/cm in linear pressure.

The invention and the advantages thereof will be understood more readily by reference to the following examples. However, these examples are intended to illustrate the invention and are not to be construed to limit the scope of the invention.

EXAMPLE 1

By using the same copying machine as the device shown in FIG. 2, an electrostatic image is formed on the photosensitive member 4 in the latent image forming station 6 according to the predetermined image forming process. Next, in the developing station 7, the developing roller 12 containing the liquid developer 10 is brought into pressure contact with the photosensitive member 4.

The developing roller 12 as used is 40 mm in outer diameter and composed by a rigid central member having an outer diameter of 34 mm, a sponge layer of butadiene-acrylonitrile rubber (NBR) provided around the central member by means of an adhesive and a seamless cylindrical net member of 200 mesh obtained by knitting polyester fibers, each having a size of 45μ provided around the sponge layer. Further, the refreshing roller 13 in pressure contact with the developing roller 12 in the liquid developer 10 is made of stainless steel and 30 mm in outer diameter. In the copying machine, the mutual pressing force acting between the developing roller 12 and the photosensitive member 4 is adjusted to 500 g/cm in linear pressure so that the maximum deformation amount of the developing roller 12 in the direction of the sponge layer thickness may be 1 mm. On the other hand, the mutual pressing force between the refreshing roller 13 and developing roller 12 is regulated to 650 g/cm in linear pressure and at that time, the maximum deformation amount of the developing roller in the direction of the sponge layer thickness is controlled so as to be 1.5 mm.

In the copying machine as outlined above, copying operation was continuously carried out in which a predetermined original was used. The maximum image density of obtained images was examined. As a result, the maximum image density of the developed image obtained in carrying out the first copying cycle was 1.10, while that of the developed image produced in repeating the copying cycle for 1,000 times was 1.05, from which it was found that change in the density of developed images given in the continuous copying operation was not so large. Further, neither of unevenness in the density and undeveloped portion were observed from any copied images so that very good images were obtained.

In addition, the above-mentioned image density was measured by using a Macbeth reflective densitometer. This is applicable to the following Comparison Example and Examples 2–5.

COMPARISON EXAMPLE

Copying operation is continuously repeated by using the same copying machine as that employed in Example 1 except that the following modifications:

In the copying machine used in the Comparison Example, the compressing force acting between the developing roller 12 and the photosensitive member 4 was regulated to 500 g/cm in linear pressure so that the maximum deformation amount of the developing roller 12 in the direction of the sponge layer thickness might be 1 mm. On the other hand, the compressing force between the developing roller 12 and the refreshing roller 13 was controlled to 350 g/cm in linear pressure so that the maximum deformation amount of the developing roller 12 in the direction of the sponge layer thickness might be 0.8 mm.

The image density of the images obtained in the Comparison Example was examined. The maximum image density of the developed image obtained in carrying out the first copying cycle was 1.06, while that of the developed image produced in repeating the copying cycle for 1,000 times was 0.75. As a result, it was found that the decrease in the density of the developed images given in the continuous copying operation was remarkable. Further, disadvantages such as lack of uniformity in the density and presence of undeveloped portions were found from the copied images given in repeating the copying operation for 30 times or more after the commencement of the copying operation.

EXAMPLES 2–5

The same copying machines as in Example 1 except for the modifications shown in the following table were employed to repeat continuously the copying operation for 1,000 times, respectively.

| Example No. | Maximum deforming amount of developing roller in the sponge layer thickness (mm) | |
|---|---|---|
| | Portion in pressure contact with photosensitive member | Portion in pressure contact with refreshing roller |
| 2 | 1 | 1 |
| 3 | 1 | 1.3 |
| 4 | 1 | 1.7 |
| 5 | 1 | 2.0 |

The maximum image density of the images obtained in each example was examined. The maximum image density of the copy image obtained in carrying out the first copying cycle as well as that of the copy image produced in repeating the copying operation for 1,000 times were measured to obtain the following results.

| Example No. | Maximum Image Density | |
|---|---|---|
| | 1st copy image | 1000th copy image |
| 2 | 1.07 | 0.98 |
| 3 | 1.10 | 1.02 |
| 4 | 1.10 | 1.06 |
| 5 | 1.10 | 1.08 |

It was found from the above results that the decrease in the density of the copy image was not so large even when the copying operation was continuously carried out. Further, no drawback such as lack of uniformity in density and presence of undeveloped portion was obseved from any copy image obtained in each example.

The present invention explained in the foregoing is capable of providing, besides the above-mentioned advantage, the following various advantages:

(1) the high-speed image formation is possible since the developing roller functions satisfactorily so that the development is carried out at very high speed.

(2) the development of an electrostatic image and strong squeeze of excessive liquid developer can be effected for a short period of time, which is convenient for construction of the high-speed copying machine, (3) the necessity of a liquid squeezing means used after development as required in the prior art is eliminated, which leads to a simplified construction of the entire apparatus, (4) the development of an electrostatic image with high accuracy as well as complete removal of excessive liquid developer can be carried out in a stable manner, and therefore it is ensured that images of high quality are formed for a long period of term, (5) strong squeeze of the liquid developer can be always achieved and this leads to formation of high quality visible images having no disturbance and a reduction in quantity of the liquid developing consumed.

(6) clear visible images free of fog may be ensured for a long time, (7) the quantity of liquid developer carried out is small and the quantity of liquid developer evaporated outwardly of the machine is small, thus reducing the possiblity of air pollution, and (8) compared with the prior art, the developing step can be carried out efficiently in a narrow area.

What we claim is:

1. A method for developing an electrostatic latent image comprising the steps of bringing a rigid member into pressure contact with a rotary member having a porous elastic member in the form of a layer provided about the periphery thereof to cause said elastic member to be refreshed therein with liquid developer in accordance with the elastic deformation of the elastic member, urging said rotary member against an electrostatic latent image bearing surface and rotating said rotary member to supply the liquid developer to said bearing surface, thereby carrying out development of the electrostatic latent image, and regulating the amount of elastic deformation of said elastic member in the direction of its thickness produced by the pressure contact thereof with said rigid member to be equivalent to or larger than the elastic deformation of said elastic member in the direction of its thickness produced by the pressure contact thereof with said bearing surface.

2. A method according to claim 1, in which said rotary member is brought into pressure contact with said bearing surface under a linear pressure of 100–800 g/cm.

3. A method according to claim 1, in which said rotary member is capable of squeezing out liquid developer when said porous elastic member is compressed and absorbing the liquid developer when said porous elastic member is restored from the compressed state.

4. A method according to claim 1, in which said elastic member is 1–10 mm thick.

5. A method according to claim 1, in which the amount of elastic deformation of said elastic member in the direction of its thickness produced by the pressure contact thereof with the rigid member is regulated so as not to exceed $\frac{2}{3}$ of the predetermined thickness of said elastic member.

6. A method according to claim 1, in which said elastic member is controlled so as to have an Asker C hardness of 10–40, measured in accordance with the standard set by the Rubber Society of Japan, SRIS-0101-1968.

* * * * *